US006878015B2

(12) United States Patent
Fan

(10) Patent No.: US 6,878,015 B2
(45) Date of Patent: Apr. 12, 2005

(54) DECORATIVE LAMP ASSEMBLY

(76) Inventor: Zhiyi Fan, 1 Zhenqian Road, Jianojiang District, Taizhou (CN), 318010

( * ) Notice: Subject to any disclaimer, the term of this patent is extended or adjusted under 35 U.S.C. 154(b) by 0 days.

(21) Appl. No.: 10/229,899

(22) Filed: Aug. 28, 2002

(65) Prior Publication Data

US 2003/0060089 A1 Mar. 27, 2003

Related U.S. Application Data

(63) Continuation of application No. PCT/CN01/00107, filed on Jan. 31, 2001.

(30) Foreign Application Priority Data

Feb. 29, 2000 (CN) ..... 00203357 U

(51) Int. Cl.[7] ..... H01R 17/00
(52) U.S. Cl. ..... 439/699.2; 439/619; 362/226
(58) Field of Search ..... 439/619, 611–618, 439/699.2; 362/226, 249, 806, 238

(56) References Cited

U.S. PATENT DOCUMENTS 4,101,187 A * 7/1978 Collier ..... 439/596
4,999,751 A 3/1991 Chen
5,330,368 A * 7/1994 Tsuruzono ..... 439/409
5,372,525 A * 12/1994 Wu et al. ..... 439/656
5,526,250 A * 6/1996 Ting et al. ..... 362/391
5,588,863 A * 12/1996 Wu ..... 439/356
5,630,729 A * 5/1997 Francis ..... 439/548
5,700,082 A 12/1997 Peng
5,791,940 A 8/1998 Chen et al.
5,820,419 A * 10/1998 Liao ..... 439/699.2
5,989,047 A * 11/1999 Huang ..... 439/252

FOREIGN PATENT DOCUMENTS

CN 2095335 U 2/1992
CN 2157604 Y 2/1994

* cited by examiner

*Primary Examiner*—Hien Vu
(74) *Attorney, Agent, or Firm*—Dorsey & Whitney LLP

(57) ABSTRACT

An improved decorative lamp assembly includes at least two core members adapted to be pieced together and defining, when pieced together, a bulb holding hole receiving channels for receiving electric wires. The at least two electric wire also includes an external member shaped and configured to contain the pieced-together core members. A bulb is received in the bulb holding hole, and electric wires are received in the electric wire receiving channels. The terminals of the bulb are connected with the ends of the electric wires in a non-separable permanent manner. This decorative lamp assembly has reliable electrical connection and good sealing performance, and also has the advantage that the manufacturing and assembly are convenient.

5 Claims, 4 Drawing Sheets

DECORATIVE LAMP ASSEMBLY

CROSS-REFERENCE TO RELATED APPLICATION(S)

This application is a continuation of International Application No. PCT/CN01/00107, filed on Jan. 31, 2001, which claims priority to Chinese Patent Application No. CN 00203357.7, filed on Feb. 29, 2000, both of which are incorporated herein by reference.

BACKGROUND OF THE INVENTION

The present invention relates to a lamp assembly used primarily for ornamentation.

SUMMARY OF THE INVENTION

In many countries of the world, particularly in European and American countries, in order to celebrate Christmas or other jubilant festivals, large amount of decorative lamps are used to add the joyous atmosphere to festivals. Among various forms of decorative lamps, the most widely used are strings of serially connected small lamps. These lamp strings not only can decorate Christmas trees, but can also be hung separately for ornamentation. Conventional decorative lamps are of an insert type, as shown in FIG. 6, which generally includes a bulb 30, a bulb holding socket base 210, a bulb socket body 220 and two electric wires 40. The bulb 30 is inserted into the bulb holding socket base 210, and the bulb 30, together with the bulb holding socket base 210, is inserted into the bulb socket body 220 so that the terminals of the bulb 30 can contact the electric wires 40 in the bulb socket body 220, thus completing an decorative lamp. In this conventional insertion-type decorative lamp, the terminals of the bulb are not connected (for example, by welding) beforehand to the electric wires, the electrical contact between the terminals of the bulb and the electrical wires is realized by inserting the bulb, together with the bulb holding socket base, into the bulb socket body to make the terminals of the bulb contact the head portions of the electric wires mounted in the bulb socket body. Hence, good contact between the terminals of the bulb and the electric wires can not be guaranteed, tending to cause an open circuit or poor electrical contact. The poor contact leads to excessively high contact resistance, thus becoming a hidden trouble of incurring a failure or even an accident.

In view of this problem in the prior art, the object of the present invention is to provide a new decorative lamp assembly with reliable electrical connections.

The object of the present invention is realized by a decorative lamp assembly, which comprises at least two core members adapted to be pieced together and defining, when pieced together, a bulb holding hole and at least two channels for receiving electric wires. The at least two electric wire receiving channels each communicate with the bulb holding hole. The lamp assembly also comprises an external member shaped and configured to contain the pieced-together core members. A bulb is received in the bulb holding hole, and electric wires are received in the electric wire receiving channels. The terminals of the bulb are connected with the ends of the electric wires in a non-separable permanent manner.

In the above decorative lamp assembly, the core members include two substantially semi-cylindrical core members adapted to be pieced together to form a substantially cylindrical body.

In the above decorative lamp assembly, the at least two core members have snap-joining means adapted to engage with each other to prevent them from being dislodged from each other.

In the above decorative lamp assembly, a locking means is provided between at least one of the core members and the external member to prevent the pieced-together core members from escaping from the external member.

The decorative lamp assembly of the present invention has the following advantages:

1. Since the terminals of the bulb are connected with the electric wires in a non-separable permanent manner, a good electrical contact can be guaranteed. Conditions, such as poor contact, which could occur in the insert-type structure will not occur in the present invention, thereby the hidden troubles of failures or accidents caused by the excessively high resistance can be avoided.

2. Thanks to the structure of the pieced-together core members plus the external member, a compact and tight assembly with good sealing property can be realized, thereby preventing water or other foreign substances from entering the assembly and impairing the performance of the electrical elements.

3. Snap-fixing or snap-joining means is provided between the core members as well as between the core members and external member to prevent dislodgement and loosening, thereby the integrity and sealing property when assembled can be further improved.

4. The structure is relatively simple, and the manufacturing and assembly operation are convenient, thus the costs are decreased.

DETAILED DESCRIPTION OF THE FIGURES

A preferred embodiment of the invention will now be described in detail with reference to the accompanying drawings wherein.

DETAILED DESCRIPTION OF THE INVENTION

Figure 1:
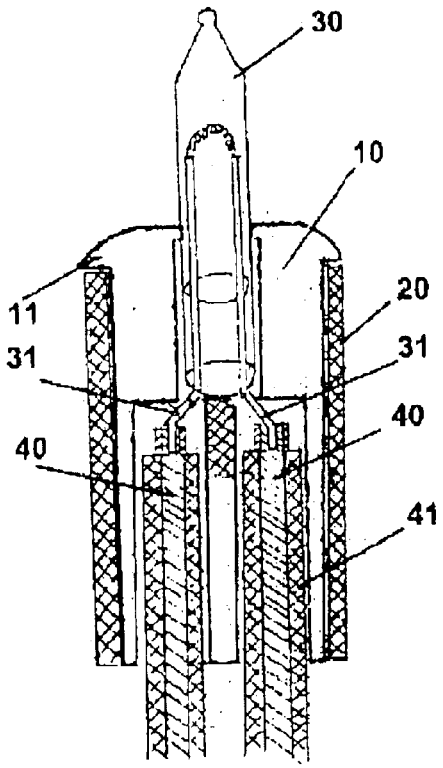
FIG. 1 is a longitudinal sectional view of a decorative lamp assembly according to the preferred embodiment of the present invention.
Figure 2:
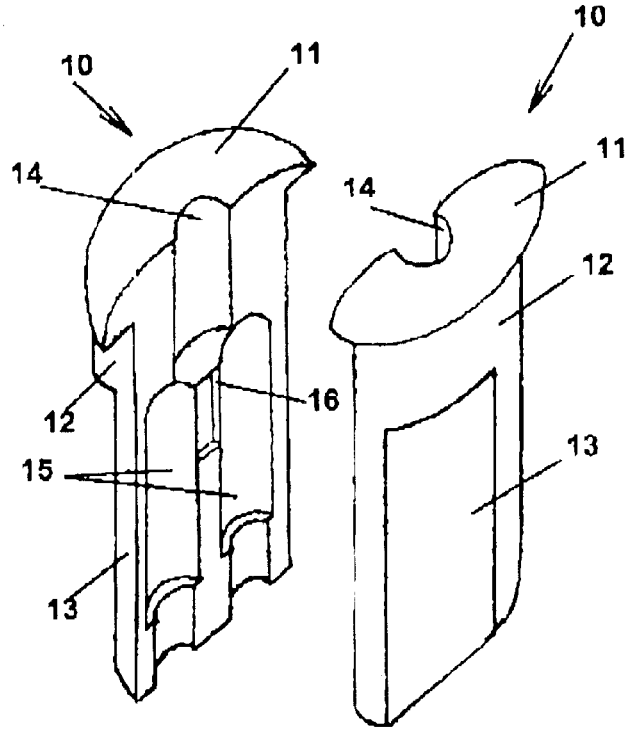
FIG. 2 is a perspective view showing that the two core members of the decorative lamp assembly are separate.
Figure 3:
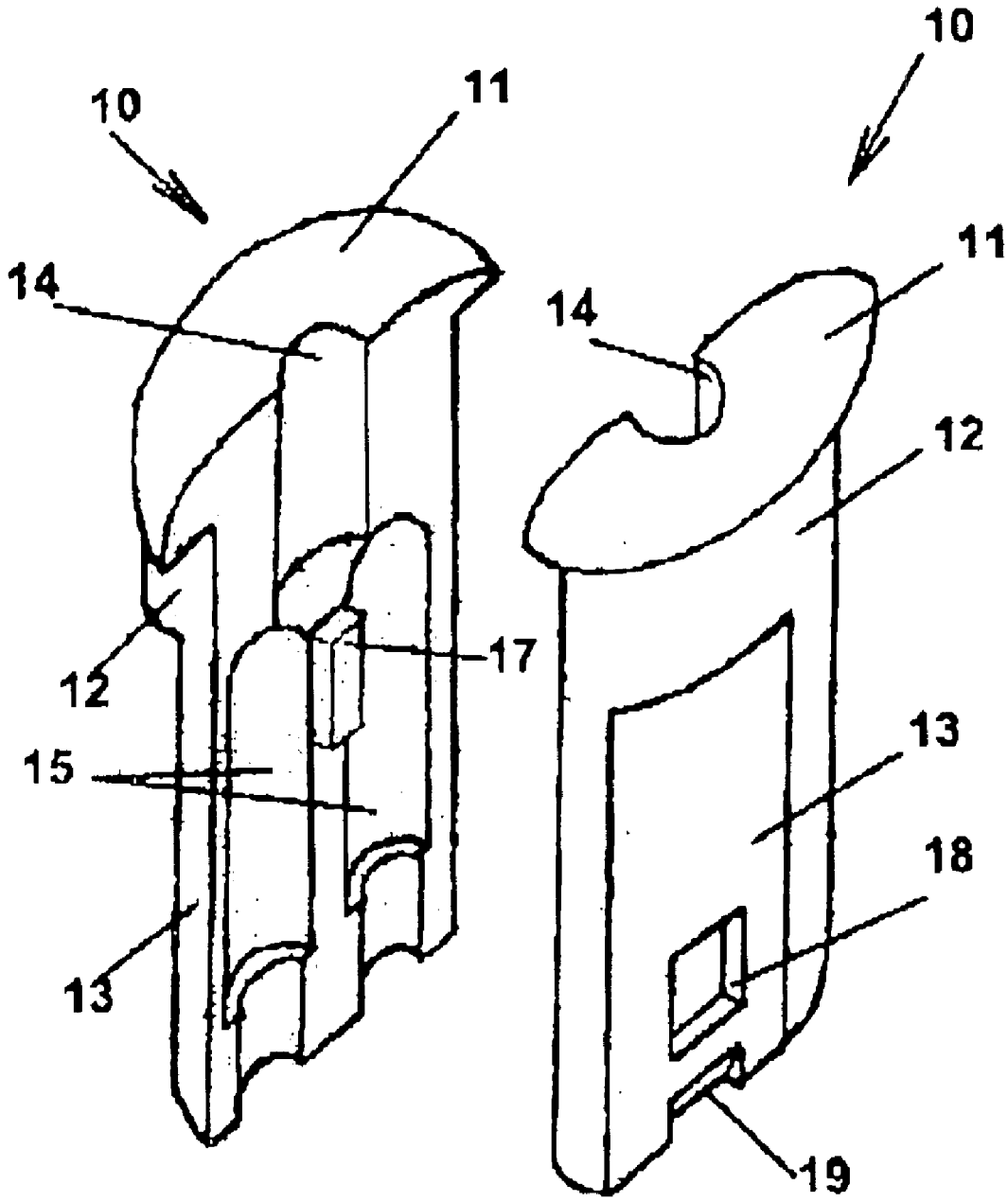
FIG. 3 is a perspective view of the core member of FIG. 2 viewed from the other side.
Figure 4:
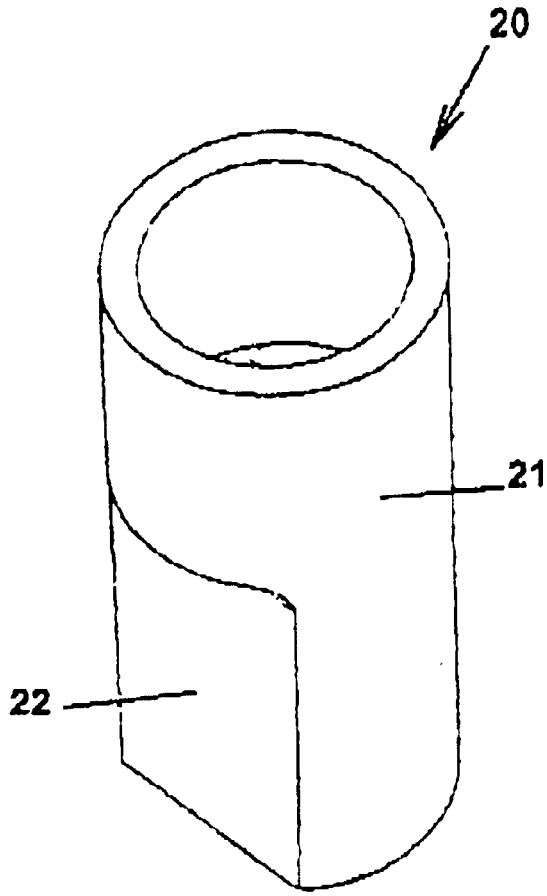
FIG. 4 is a perspective view showing the external member of the decorative lamp assembly.
Figure 5:
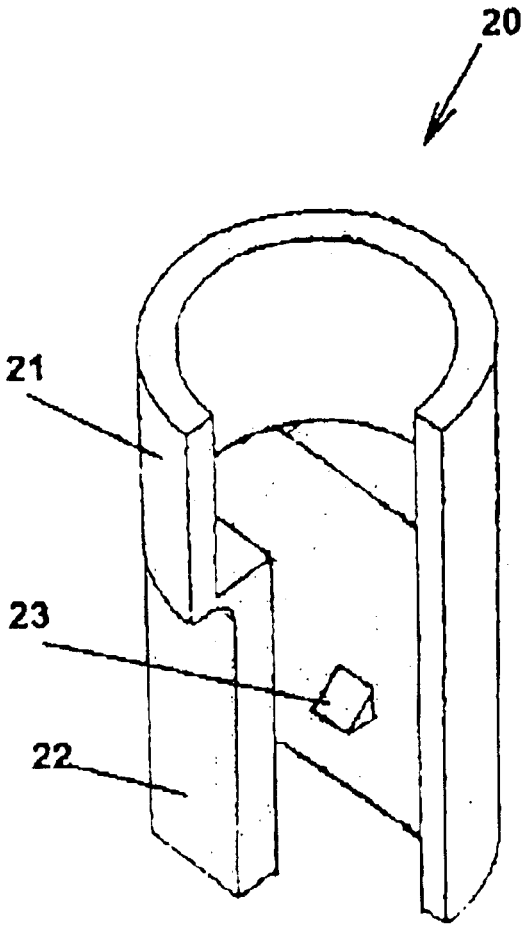
FIG. 5 is a partially cutaway perspective view of the external member shown in FIG. 4.
Figure 6:
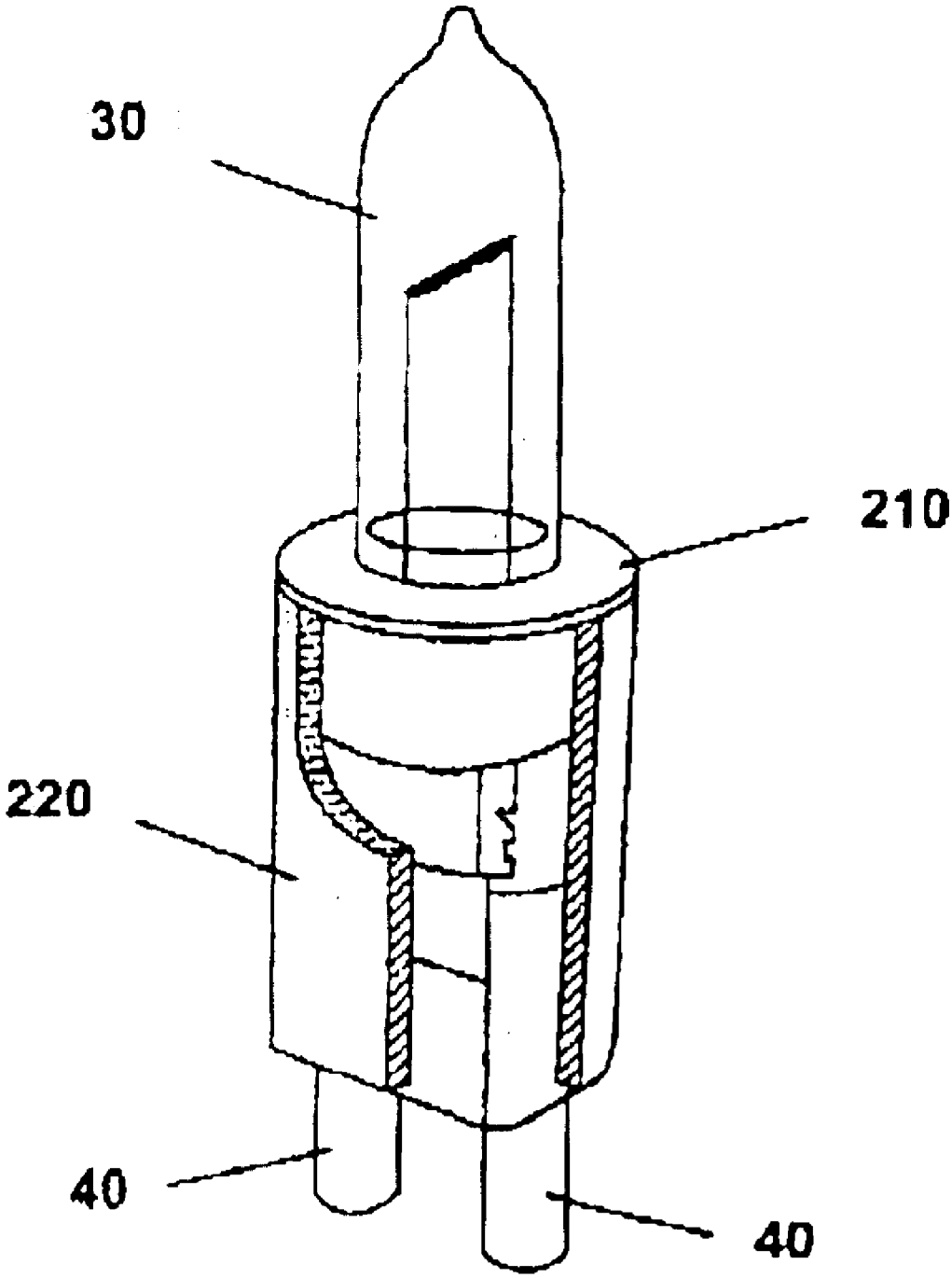
FIG. 6 is a partially cutaway perspective view of a conventional decorative lamp assembly of insert-type.

Referring to the drawings, the decorative lamp assembly of the present invention generally includes two core members 10, an external member 20, a bulb 30 and two electric wires 40. The two core members 10 are generally of the shape of semi-cylindrical bodies symmetric to each other. Each core member 10 generally includes a flange 11, a semi-cylindrical portion 12 and a cuboid extension portion 13. The assembly also includes a central recess 14 for forming a bulb holding hole, and two parallel recesses 15 for forming two electrical wire receiving channels. When the two core members are pieced together, the central recess 14 and the parallel recesses 15 define respectively a bulb holding hole and two parallel electrical wire receiving channels. These two electric wire receiving channels each communicate with the bulb hole to allow electrical connections. The parallel recesses are slightly narrowed at their lower portions so that the electric wires received in the electric wire receiving channels can be clamped tightly. In one of the core members, a substantially rectangular depression 16 is formed at a position between the two electric wire receiving channels, and a raised block 17 is formed at a corresponding position in the other core member. The depression 16 and the raised block 17 can be fitted to each other when the core members are pieced together, to help the registration of the two core members during assembly operation and to prevent the potential shift between the two core members when assembled. On the outer wall of the cuboid extension portion 13 of one of the core members 10, a dent 18 is formed near the lower portion there of to engage a wedge-shaped protrusion 23 (to be described later) formed on the external member 20 when the core members are inserted into the external member 20, to perform a locking function. There is further provided a slope 19 below the dent 18 at the bottom edge of the core members 10, which is used to guide the wedge-shaped protrusion 23 to enter the dent 18.

The external member 20, corresponding to the configuration of the core members 10, includes a cylindrical cavity portion 21 and a cuboid cavity portion 22 which are integrated into one unit. In this way, the external member 20 is adapted to tightly contain the pieced-together core members 10. On the inner wall of the cuboid cavity portion 22 of the external member 20, at a position corresponding to the position of the dent 18, there is formed a wedge-shaped protrusion 23, which is adapted to fit into the dent 18 on the outer wall of the core members 20 when the pieced-together core members 10 are inserted into the external member 20.

As can be seen clearly from FIG. 1, the two pieced-together core members 10 (only one of them is shown) are inserted in to the external member 20, with their flanges 11 resting against the upper edge of the external member 20. The bulb 30 is received in the bulb holding hole, and the electric wires 40 are received in the electric wire receiving channels. The terminals 31 of the bulb are respectively connected with the ends of the electric wires 40. The connection may be carried out by means of welding or riveting, thereby a permanent electric connection can be achieved. The electric wires 40, with the exception of the ends thereof, are surrounded by insulation wraps 41.

The decorative lamp assembly of the present invention can be assembled by means of the following process: firstly the terminals of the bulb are respectively connected permanently with the two electric wires by means of welding, for example; then the connected bulb and electric wires are interposed between at least two core members; after that, the at least two core members are pieced together to clamp the bulb and the electric wires; finally, the pieced-together core members, together with the clamped bulb and electric wires, are inserted into the external member.

We claim:

1. A decorative lamp assembly, comprising;

a first longitudinal member;

a second longitudinal member;

an external member retaining the first and second longitudinal members;

each of the first and second longitudinal members having two parallel longitudinal recesses for forming two channels to retain two electric wires that are disposed longitudinally along the two parallels longitudinal recesses, respectively, and a central longitudinal recess positioned between the two parallel longitudinal recesses for forming a bulb holding bore to receive a bulb; and wherein two terminals of the bulb are permanently electrically connected to two ends of the electric wires in the bulb holding hole by bonding to each other.

2. The decorative lamp assembly according to claim 1, wherein the first and second longitudinal members are two substantially semi-cylindrical core members being pieced together to form a substantially cylindrical body.

3. The decorative lamp assembly according to claim 1, wherein the first and second longitudinal members have snap-joining means to engage with each other to prevent the first and second longitudinal members from being dislodged from each other.

4. The decorative lamp assembly according to claim 1, wherein a locking means is provided between at least one of the first and second longitudinal members and the external member to prevent the first and second longitudinal members from escaping from the external member.

5. A method of assembling a decorative lamp assembly, comprising:

providing a first longitudinal member, a second longitudinal member, and an external member retaining the first and second longitudinal member, wherein each of the first and second longitudinal members having two parallel longitudinal recesses for forming two channels to retain two electric wires that are disposed longitudinally along the two parallel longitudinal recesses, respectively, and a central longitudinal recess positioned between the two parallel longitudinal recesses for forming a bulb holding bore to receive a bulb;

coupling the bulb and the electric wires to each the other in a permanently inseparable manner, wherein two terminal of the bulb are permanently electrically connected to two ends of the electric wires in the bulb holding bore by bonding to each other;

enclosing the coupled bulb and the electric wires in two core halves of a core member by engaging the two core halves with each other; and fitting the enclosed bulb and electric wires and the two core halves as a whole within an external member, wherein the two core halves tightly enclose the bulb and electric wires, thereby preventing the bulb from disengaging from the core member and the electric wires.

* * * * *